US010077147B2

(12) United States Patent
Stone et al.

(10) Patent No.: US 10,077,147 B2
(45) Date of Patent: Sep. 18, 2018

(54) CUPPED COMESTIBLE PACKAGE

(71) Applicants: Abagale Stone, Palisade, CO (US); Garrick S. Stone, Palisade, CO (US)

(72) Inventors: Abagale Stone, Palisade, CO (US); Garrick S. Stone, Palisade, CO (US)

( * ) Notice: Subject to any disclaimer, the term of this patent is extended or adjusted under 35 U.S.C. 154(b) by 190 days.

(21) Appl. No.: 14/999,411

(22) Filed: May 3, 2016

(65) Prior Publication Data

US 2016/0325900 A1 Nov. 10, 2016

Related U.S. Application Data

(60) Provisional application No. 62/179,362, filed on May 5, 2015.

(51) Int. Cl.

| | |
|---|---|
| ***B65D 73/00*** | (2006.01) |
| ***B65D 75/32*** | (2006.01) |
| ***B65D 85/60*** | (2006.01) |
| ***B65D 75/56*** | (2006.01) |

(52) U.S. Cl.

CPC ..... *B65D 75/324* (2013.01); *B65D 75/566* (2013.01); *B65D 85/60* (2013.01)

(58) Field of Classification Search

CPC .... B65D 75/324; B65D 75/566; B65D 77/04; B65D 85/60

USPC ..... 206/461–465, 470, 471

See application file for complete search history.

(56) References Cited

U.S. PATENT DOCUMENTS

| | | | | |
|---|---|---|---|---|
| 3,164,478 | A * | 1/1965 | Bostrom | B65D 85/36 206/303 |
| 3,288,278 | A * | 11/1966 | Rich | B65D 75/32 229/238 |
| 3,776,375 | A * | 12/1973 | Rohdin | B65D 75/22 206/459.5 |
| 3,948,455 | A * | 4/1976 | Schwartz | B65D 83/0847 206/394 |
| 4,002,773 | A | 1/1977 | Entennman | |
| 4,512,474 | A * | 4/1985 | Harding | B65D 75/225 206/461 |
| 4,606,460 | A * | 8/1986 | Luray | B65D 81/07 206/583 |
| 6,003,671 | A | 12/1999 | McDonough | |
| 6,146,673 | A | 11/2000 | Ferguson | |
| 6,176,375 | B1 | 1/2001 | Truscello et al. | |
| 6,357,172 | B1 * | 3/2002 | Risgaard | A01G 13/0243 47/32.4 |
| 6,896,140 | B1 | 5/2005 | Perry | |
| 6,905,014 | B2 * | 6/2005 | Eldin | A45C 1/10 206/0.84 |

(Continued)

*Primary Examiner* — Luan K Bui

(74) *Attorney, Agent, or Firm* — Kyle W. Rost

(57) ABSTRACT

A package for holding one or more cup-contained comestible units in a vertical column, whereby the package is thermoformed of plastic in two mating flanged thin-walled clam-shell halves. The clam-shell halves together form one or more comestible compartments, each with an intermediate cup retainer ring for overlying the upper edge of a cup(s) to restrain the cup-wrapped comestible unit(s) from movement, and enabling clean insertion and removal of the comestible units without hand contact with toppings. Each compartment has a lower section for containing the cup, an upper section for containing topping above the cup, and an intermediate retainer ring.

16 Claims, 15 Drawing Sheets

(56) References Cited

U.S. PATENT DOCUMENTS

| | | | | |
|---|---|---|---|---|
| 7,556,152 | B2 * | 7/2009 | Lechelle | B65D 75/24 206/470 |
| 8,167,128 | B2 | 5/2012 | McGinnis | |
| 2011/0048997 | A1 | 3/2011 | Vandervliet | |
| 2011/0278192 | A1 * | 11/2011 | Thornton | B65D 73/0092 206/464 |

* cited by examiner

OTHER ART

CUPPED COMESTIBLE PACKAGE

BACKGROUND OF THE INVENTION

Dependency

This Utility application is based upon prior-filed U.S. Provisional Application No. 62/179,362 filed on May 5, 2015, having the same inventorship.

Field of the Invention

The present invention relates to packaging for food products. More particularly, the invention relates to packaging for comestibles formed in or placed in cup-like liners. Such food products include baked items such as cakes, cupcakes, donuts, brownies, muffins, and other pastries as well as certain frozen food items such as ice cream, and including puddings and the like marketed in cups.

Description of the Prior Art

Comestibles such as cupcakes, muffins, and individual-serving cakes are typically formed by placing cups in frustoconical cavities of a baking pan, placing worked cake dough in the cups, and baking the dough to substantially fill the cups, and in some cases, overflowing the cups. Each cup itself is typically formed from a round sheet of paper, plastic, metal or composite film wherein a continuous side panel is formed by pleating , i.e. corrugating the outer portions of the sheet and folding such portions upwardly about a flat central bottom. Cup size and shape are designed to conform to the size and shape of the cavities in a baking pan. Pan cavities having various sizes and shapes (and corresponding cup sizes and shapes) are in common use commercially for retaining various types of comestibles. The cups are also called "liners" and "baking liners" in the baking art.

Prior art packaging for cakes, cupcakes, muffins and the like have been of several types. Multiple units of commercially produced cupcakes and muffins are typically sold in single-level boxes formed of paper, cardboard, or plastic, with covers. Covers may be hinged to the container or be formed separately for placement over the containers. Such packaging is illustrated in U.S. Pat. No. 4,002,773 dated Jan. 11, 1977, to Entenmann. In this reference, a tray with spaced openings for each cupcake is inserted into the box for holding the cupped items. While these containers are relatively inexpensive, tipping or inversion of the package will result in displacement of cupcakes against the cover and/or side walls of the container. Topping, e.g. icing on the cupcakes will then adhere to the package and the topping may be damaged. Not only is this a problem for commercial bakers, but is especially important to artisan bakers who apply fanciful topping designs to cupcakes, and to entrants in competitive baking contests.

In such prior art packaging, cupcakes are commonly removed from the package by placing one's fingers about the upper part of the cup and icing, and lifting the cupcake vertically. Transfer of icing from the cupcake to one's fingers and concurrent damage to the cupcake topping design are common results.

U.S. Pat. No. 6,003,671 dated Dec. 21, 1999 to McDonough et. al. describes a cupcake storage container for a horizontal array of a plurality of cupcakes. In this reference, the container includes within each cup holder one or more protrusion members which project into the side of the paper/foil baking cup, below the edge of the cup, to hold the cup and cupcake in place. The protrusions may take the form of bumps, points which pierce the baking cup, or rings which project into the lower portion of the baking cup. In addition, the reference shows a cupcake holder with a horizontal surface which may be folded to release the cupcakes upwardly.

Even with these improvements to the cupcake package, vertical removal of the cupcake from the container is required, necessitating contact of one's fingers with the upper portion of the icing and/or cup contents. Furthermore, deformation of the cupcake will occur. Piercing of the cup may lead to contamination of the cupcake, resulting in unsalable product.

U.S. Pat. No. 6,146,673 dated Nov. 14, 2000 to Ferguson discloses a baked goods container for storage and transportation, having stepped or sloped members therein for supporting one or more removable inserts. Each insert is generally flat, with a plurality of holes for supporting cupcakes. The inserts are sized to rest at a different level within the container. There is not shown any means for preventing damage to the baked goods in the event the container is tipped or inverted. Furthermore, the container is not configured for retail display of the goods. However, the removable inserts of Ferguson permit placement on a flat surface and downward movement to increase the portion of each cup side available for finger removal of the cupcakes.

Although single cupcakes are sometimes sold unpackaged, this is not always true. For example, some commercial single cakes and cupcakes with frosting are pre-packaged in thin plastic film. Often, the cupcakes are supported on a cardboard cutout member. A hard frosting is used to minimize damage thereto in shipment and display. Nevertheless, a portion of the frosting may stick to the plastic film and be discarded or licked off by the consumer.

U.S. Pat. No. 6,896,140 B1 dated May 24, 2005 to Perry discloses a crush-proof cupcake holder for a single cupcake. The interior includes a suspended cupcake tray assembly which is connected to a hinged lid such that raising the lid lifts the cupcake for removal. The tray assembly includes pin members which press into the sides of the cupcake for holding it laterally in place. The lid includes downwardly extending pins which press into the cupcake frosting to limit the upward travel of the cupcake.

As illustrated in the drawings of Perry, when the holder is opened for removal of the cupcake, the cupcake is extracted vertically by finger contact with the upper part of the cake itself and/or icing thereon. Furthermore, there is possible topping damage resulting from the downwardly extending pins.

U.S. Patent Application Publication No. 2011/0048997 A1 published Mar. 3, 2011 to Vandervliet discloses a package for a single cupcake wherein various means for preventing upward movement of a cupcake within the package include (a) toothpicks or dowels inserted completely through the package walls and the cupcake itself, (b) pyramidal protrusions projecting from inner walls of the package to indent or extend into the cupcake, and (c) ridges on the package walls which press into the cupcake sides. Such deformation of the cupcake is undesirable. Projection of toothpicks or dowels into the cupcake body are possible sources of contamination, and are considered undesirable from a commercial standpoint. A cupped product which is in a semi-liquid or semi-solid form may leak from a pierced cup. Alternatively, premature drying of the cup contents may be a problem.

Like the prior art already discussed, removal of the cupcake from the Vandervliet package requires upward (i.e. vertical) movement of the cupcake. The package includes a hole in its base for extending a finger therein to push the cupcake upwardly. FIG. 1F of the reference's drawings illustrate removal of a cupcake from the package, wherein three fingers are in contact with icing thereon.

U.S. Pat. No. 8,167,128 B2 dated May 1, 2012 to McGinnis et al. discloses a hinged clamshell type holder for a single cupcake, having a securement device therein. The securement device comprises prongs extending from the inner wall to press fit against the sides or upper area of the cupcake's baking liner i.e. cup. The holder permits lateral removal of the cupcake therefrom.

U.S. Pat. No. 6,176,375 B1 dated Jan. 23, 2001 by Trucello et al. discloses a food product holder for a cup having an outwardly-extending flanged upper rim. A lower section of the holder includes a corrugated container which encloses the cup. The upper section of the holder comprises a cap which, when placed on the lower section, intersects with the cup flange to hold it in place. Removal of the product is achieved by removing the cap and lifting the cup flange from the corrugated container.

A macaroon cookie package seen by co-inventor of the instant application (Garrick S. Stone) at the International Vision EXPO & Convention in Las Vegas, Nev. on Sep. 18, 2014 is illustrative of another type of package. Shown in FIG. 1, the drawing is labeled OTHER ART, inasmuch as its possible priority date is unknown. The cookie package 101 has an inner package 103 comprised of two identical flanged parts 103A and 103B, each of which contains five compartment halves 104 connected by hollow necks 105. As seen, five unfrosted macaroon cookies 106 were contained in the inner package 103 wherein the two flanged parts 103A and 103B were loosely held together by a second (outer) carton 107 surrounding the inner package. Each macaroon 106 was positioned loosely within a separate pair of matching compartment halves 104 in the inner package. Thus, for example, each macaroon 106 had a diameter of 1.75 inches and a height of about 0.75 inches, while each full compartment had an inside diameter of 1.92 inches and an interior height of about 1.1 inches. No means were provided for holding a macaroon immobile within a compartment. Furthermore, the inner package 103 tended to rotate up to about +/−40 degrees within the outer carton 107, whereby the two flanged parts 103A and 103B can become separated by an additional 30+ percent of the compartment diameter. The package's construction enables substantial movement of a macaroon in all directions within a compartment. Thus, use of this package for containing fragile comestibles such as cupcakes, muffins, and the like is contra-indicated.

In summary, comestible packages of the prior art do not permit ready manual insertion and removal of cupcakes or muffins by hand or finger contact with the cup exterior only. In addition, prior art packaging is not disposed to the stacking of a plurality of such cupped comestible units e.g. cupcakes within a single package whereby clean manual removal of the comestible units is readily possible and easy. Cookie packaging is not suitable for use with cupcakes and the like. Other differences and advantages of the instant invention will become apparent in the following description and drawings.

SUMMARY OF THE INVENTION

It is an object of the instant invention to provide a package for containing one or more individually cup-wrapped comestible items. The package is formed to enable convenient placement, storage, distribution, sale, display, and removal of individual cup-wrapped items such as cakes, cupcakes, muffins and the like, including pastries, brownies and donuts, and may be applied to the packaging of cup-wrapped frozen or refrigerated items such as frozen desserts, dairy products and the like, but not limited thereto. In this discussion, the term "cup-wrapped product" will be used generically to denote any product formed or placed in a cup or cup-like wrapper. Such cup-like wrappers are also known as liners in the baking industry. The cup may have pleated or unpleated sides, but the invention will be described and illustrated using a round cupcake within a pleated cup. The term "topping" will be used generically to indicate any material(s) applied to the upper surface of the cup contents. As is well-known, topping typically includes frosting applied to the upper surface of cupcakes.

A package of the invention has a continuous thin wall in a clamshell configuration. Two lateral halves of the clamshell package are each surrounded by a circumferential flange with a planar vertical face. The respective flanges may be joined along one vertical edge to provide a hinge therebetween. The two flanges are joinable face-to-face to close the package, and contain connectors for locking the package halves together in a closed position.

The clamshell package contains one or more compartments, each compartment configured for holding a comestible unit. Each compartment comprises a compartment half from each of the two clamshell halves. Each compartment has a general hourglass shape. A lower section thereof has a floor for supporting a cup bottom, and preferably has a shape which provides additional space about the cup sides for ready insertion and removal by hand. An upper section is shaped to contain a topping portion of the comestible. The upper and lower sections are separated by an annular retainer ring which overlies the peripheral upper edge of the cup to retain the comestible substantially immobile without damaging the cup, the cup contents, or topping thereon. Each retainer ring includes a semi-circular ring from each of the two clamshell halves. In a multi-compartment package, the compartments are stacked vertically, one above the other within the package.

The invention includes a base into which the clamshell package portion may be inserted and held thereby, enabling the entire package to stand on a flat surface. The clamshell flanges may also be provided with a hanging tab for suspension of the package or the clamshell portion thereof from a hanger.

Thus, the invention comprises a clamshell type package which prevents damage to cup-wrapped product(s), including toppings thereon, resulting from (a) package inversion, (b) subjection to vertical and/or lateral forces, and/or (c) hand contact with the topping during insertion and/or during removal of the cup-wrapped comestible product.

In view of the objects presented above and further presented, an embodiment of the invention comprises a package for one or more units of a cup-contained product such as a cupcake, especially such products having a topping extending upwardly from the top of the cup contents. The package walls form one or more two-part compartments for containing the product unit(s). Each hourglass-shaped compartment is comprised of a lower section for supporting a cup on a floor, and an upper section for containing topping extending above the cup. The two sections are separated by two semi-circular retainer ring portions which together encircle the cup-contained unit atop the outermost portion of the cup's upper periphery (or overflow comestible lip) to retain the cup as well as the cup contents and topping.

The two clamshell halves may be formed as a single unit, the halves being connected along a hinge line. Alternatively, each clamshell half may be separately formed; the two halves connectable along their respective flanges.

Each of the cup-contained comestible units is protected from undue movement within the package by the two semi-circular retainer ring portions, and from the external atmosphere by package closure. When the two flanges are separated, i.e. opened, a cup-contained unit may be laterally inserted into (or laterally withdrawn from) a compartment half in one of the clamshell halves, and the package closed by joining the other clamshell half thereto.

The interior of the lower section of each compartment in the package is configured such that, when opened to expose one side of the cup-contained product, sufficient finger space about the cup itself is provided in the lower section of the compartment in at least one clamshell half to enable ready lateral insertion and removal of the product, e.g. cupcake, by finger contact with the cup only, avoiding finger contact with the cup contents or topping.

In one embodiment, the instant clamshell type package is configured with a plurality of compartments for holding two to six (or more) comestible mils, each compartment with its own pair of semi-circular retaining rings. The comestible product units are separably stackable vertically, one above another, each in a separate compartment within the package.

In one form of the invention, the clamshell type package of the invention includes a separately-formed base into which the clamshell portion is insertable, enabling the package to stand on a flat surface, and providing additional security for the bottom of the flanged package. The base of the invention is especially useful for packages having two or more vertically stacked compartments.

Other features and advantages of the present invention will readily become apparent upon a careful reading of the subsequent detailed description with reference to the appended drawings, wherein like parts are given like reference numerals. The terms "frontal", "upper", " lower", "lateral", " bottom", and "top", with respect to the invention in the various drawing views, are intended to enable a clear description of the features without limiting those features to a particular location unless so designated.

BRIEF DESCRIPTION OF THE DRAWINGS

The figures of the drawings show representative aspects of the various embodiments of the invention claimed herein, wherein:

REFERENCE NUMERALS FOR CUPPED COMESTIBLE PACKAGE

Figure 1:
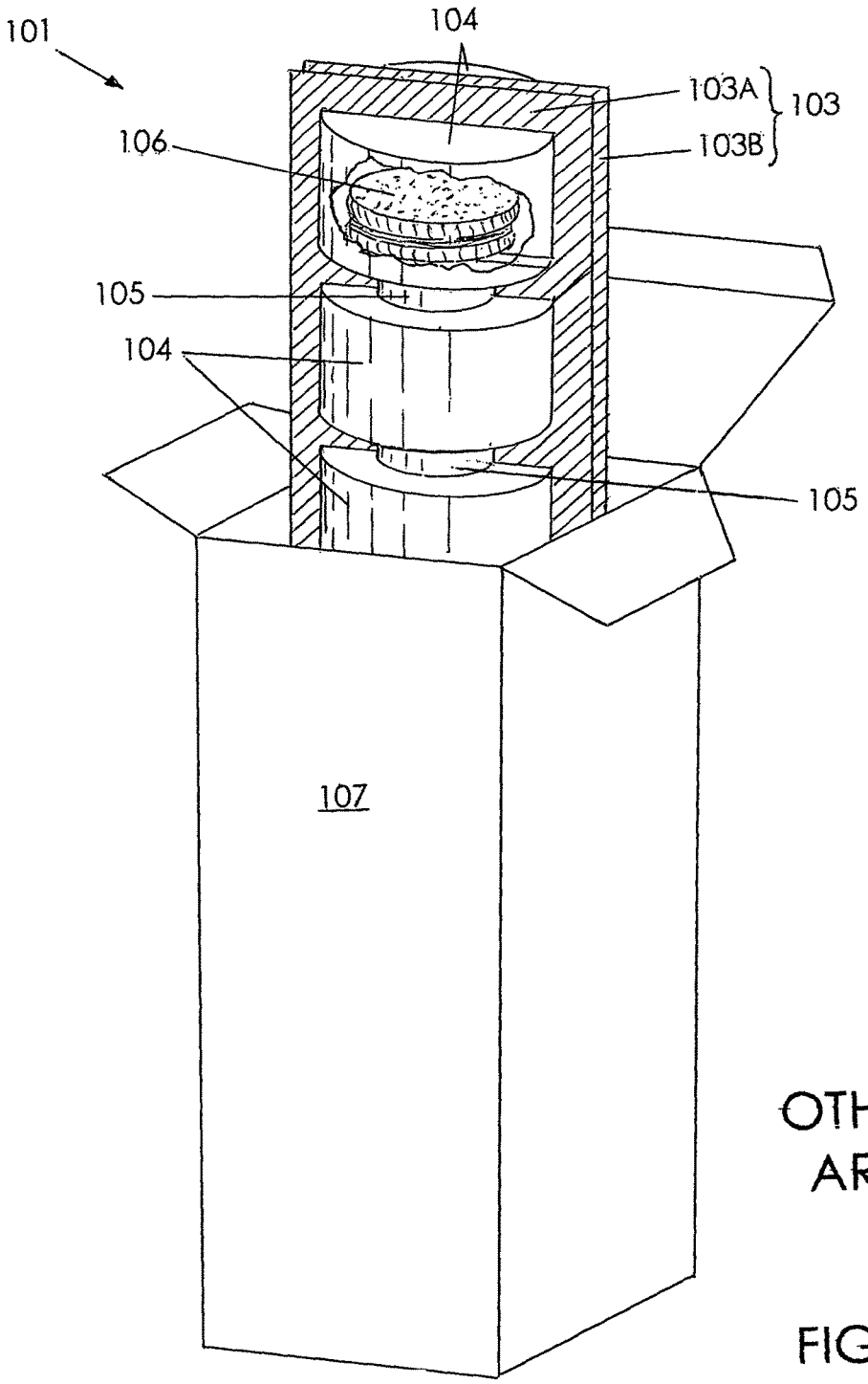
FIG. 1 is a frontal perspective view of an OTHER ART cookie package in a partially open condition. It's effective priority date is unknown.

The following reference numerals are used throughout the detailed description and figures of the application:

2 comestible unit
3 cup
4 side of cup
5 cup bottom
6 upper edge of cup
7 cupped portion of comestible e.g. cupcake
8 topping portion of comestible e.g. cupcake
9 diameter of cup edge
10 package
11 wall
11A wall thickness
11C sidewall of upper space 44

11D sidewall of lower space
12 clamshell
12A first clamshell half
12B second clamshell half
13 clamshell width
14 clam shell height
15 centerline of package
16 base member
17 cavity in base member
18A flange of clamshell half 12A
18B flange of clamshell half 12B
19A lower portion of flange 18A
19B lower portion of flange 18B
20 hinge line
20A length of hinge line
21 slots/perforations in hinge line
22 hinge
23 hinge members
23A cumulative length of 23
24 connectors
24A male detent (connector)
24B female detent (connector)
25 hanging tab
26A lateral flange edge line
26B lateral flange edge line
27 aperture through hanging tab 29
28 directions of movement
29A bottom edge of flange 18A
29B bottom edge of flange 18B
30A closing edge of flange 18A
30B closing edge of flange 18B
31A upper edge of flange 18A
31B upper edge of flange 18B
32 neck (32A and 32B)
33 inner surfaces of flanges
33A inner surface of flange 18A
33B inner surface of flange 18B
34A lower portion of clamshell half 12A
34B lower portion of clamshell half 12B
35 aperture in neck 32
36 diameter of aperture 35
37 diameter of neck
38 width of flange 18A or 18B
39 flange height
40 pull-apart tabs 40A & 40B
41 aperture extension
41A neck extension
42 lower space of each compartment
43 diameter of retainer hole 45
44 upper space of each compartment
45 central hole in retainer
46 retaining ring of each compartment
46A projection of retaining ring
47 outer wall of base member 16
48 upper surface of base member 16
49 foot flange of base member 16
50 walls of cavity 17 of base member
51 opposed cavity extension in b.m.
52 cavity extension in floor 53
53 cavity floor in cavity 17
54 diameter of foot flange 49
55 central depression in cav. floor 53
56C sidewall diameter of wall 11C
56D sidewall diameter of wall 11D
57 cup footprint
58 dia. of footprint 57
59 clamshell circumference
60 lowermost (1st) compartment
60A first half- compartment of 60
60B second half- compartment of 60
61 2nd compartment
61A first half-compartment of 61
61B 2nd half-compartment of 61
62 3rd compartment
63 4th compartment
63A 1st half-compartment of 63
63B second half-compartment of 63
64 octagonal compartment
65 rib
66 bump
67 support planes with bumps
68 planar direction
69 non-planar direction
70 compartment floor
70A,B lowest floor
73 ceiling in each compartment
80 integral base
81 upper wall of base 80
82 lower wall (floor) of base 80
83 cavity in base 80
84 flange extensions to allow connectors
85 radius of base 80
86 radius of clamshell 12
87 periphery of upper wall 81
88 sidewall of base 80
89 outer periphery of lower floor 82
90 package (embodiment 2)
93 frusto-conical angle of lower section of package 10
95 angle with the vertical
96 angle with the vertical
99 recess in retainer ring
101 OTHER ART cookie package
102 inner package of 101
103A flanged part of 101
103B flanged part of 101
104 compartment halves
105 hollow neck
106 cookie
107 outer carton of 101
110 box hinge
110A,B,C,D,E,F,G longitudinal members of box hinge
111 joint between members of hinge 110
112 stacking step
113 outside diameter of step 112
114 inside diameter of flange 49
115 height of step 112
116 overall height of base 80

DETAILED DESCRIPTION OF THE INVENTION

As already indicated, the invention is a package for comestibles such as cakes, cupcakes, muffins, and other baked comestibles, as well as frozen desserts and refrigerated items such as puddings and the like. The invention is especially applicable to cup-contained comestibles. FIGS. 2 through 5 illustrate a first exemplary embodiment of package 10 of the invention. This embodiment is configured to contain a plurality of cup-contained comestible units 2, such as, for example, cupcakes, in a vertical orientation which protects the units 2 from damage and enables easy insertion and removal without touching the topping with one's fingers.

As depicted in FIGS. 2-5 of the drawings, a first embodiment of an exemplary comestible package 10 of the invention is depicted as a clamshell 12 having two clamshell halves 12A, 12B. The clamshell halves are shown as being bounded by respective flanges 18A and 18B which extend outwardly about the open side of each clamshell half. In this embodiment, flanges 18A, 18B are moveably joined by intervening hinge members 23 along hinge line 20. In this embodiment, both clamshell halves 12A and 12B, together with hinge members 23, are shown as being formed as a single structure, its wall 11 having a uniformly thin wall thickness 11A.

Exemplary clamshell half 12A is shown with a plurality of half-compartments 60A, 61A, 62A, and 63A. Likewise, clamshell half 12B is shown with a matching plurality of half-compartments 60B, 61B, 62B, and 63B. Thus, each compartment comprises two half-compartments separated by a vertical plane through centerline 15, hingeline 20, and lateral closing edge lines 26A and 26B. In this embodiment, the two flanges 18A, 18B are shown as being foldably joined by hinge members 23 along straight hinge-line 20 whereby the flanged clamshell halves 12A, 12B may be rotated relative to each other in directions 28 to alternatively open and close the clamshell 12 (see FIG. 3). Thus, when closed, half-compartments 60A and 60B together become compartment 60, half-compartments 61A and 61B become compartment 61, and so on. In the closed package 10, the clamshell halves 12A and 12B are complementary to each other about vertical center line 15 of the total package. The hinge members 23 alternate with slots or perforations 21 along hinge-line 20.

In the foregoing figures, flange 18A is connected to flange 18B by hinge members 23 along hinge line 20. In addition, each flange 18A, 18B has a lateral opening edge 30A or 30B formed along edge lines 26A and 26B, respectively, together with an upper edge 31A, 31B, respectively, and a lower edge 29A, 29B respectively, as depicted in FIGS. 2-5.

Each flange 18A and 18B is shown with an overall flange width 38 which is greater than the width or diameter 13 of half-compartments 60A, 60B, 61A, 61B, etc. Likewise, the overall flange height 39 is greater than the overall clamshell height 14. The inner surfaces 33A, 33B of extended flanges 18A, 18B thus strengthen package 10 both laterally and vertically, and comprise peripheral sealing surfaces when package 10 is closed. In the closed position, the two flanges 18A and 18B are generally co-extensive and in contact with each other to provide sealing therebetween.

When package 10 is closed by folding the flanged clamshell halves 12A and 12B along hinge-line 20, the lower ends 34A and 34B of clamshell halves 12A and 12B, including lower flange portions 19A, 19B may be inserted into a separate base member 16, described infra. Typically, all of the hinge members 23 have a cumulative length less than about one half of the total length 20A of hinge line 20. Preferably, cumulative hinge member length is less than about one-fourth of the hinge line length 20A, (see FIG. 2) with hinge members 23 generally evenly spaced along the hinge line 20. The ratio depends upon various factors such as the material of construction and its bending characteristics, wall thickness 11, package size and the like. If desired, the wall thickness of the hinge members 23 may be reduced along hinge line 20 to enhance bendability. In such cases, the hinge members may occupy a greater portion of the hinge length 20A, even up to 100 percent, i.e., a full living hinge.

Figure 5:
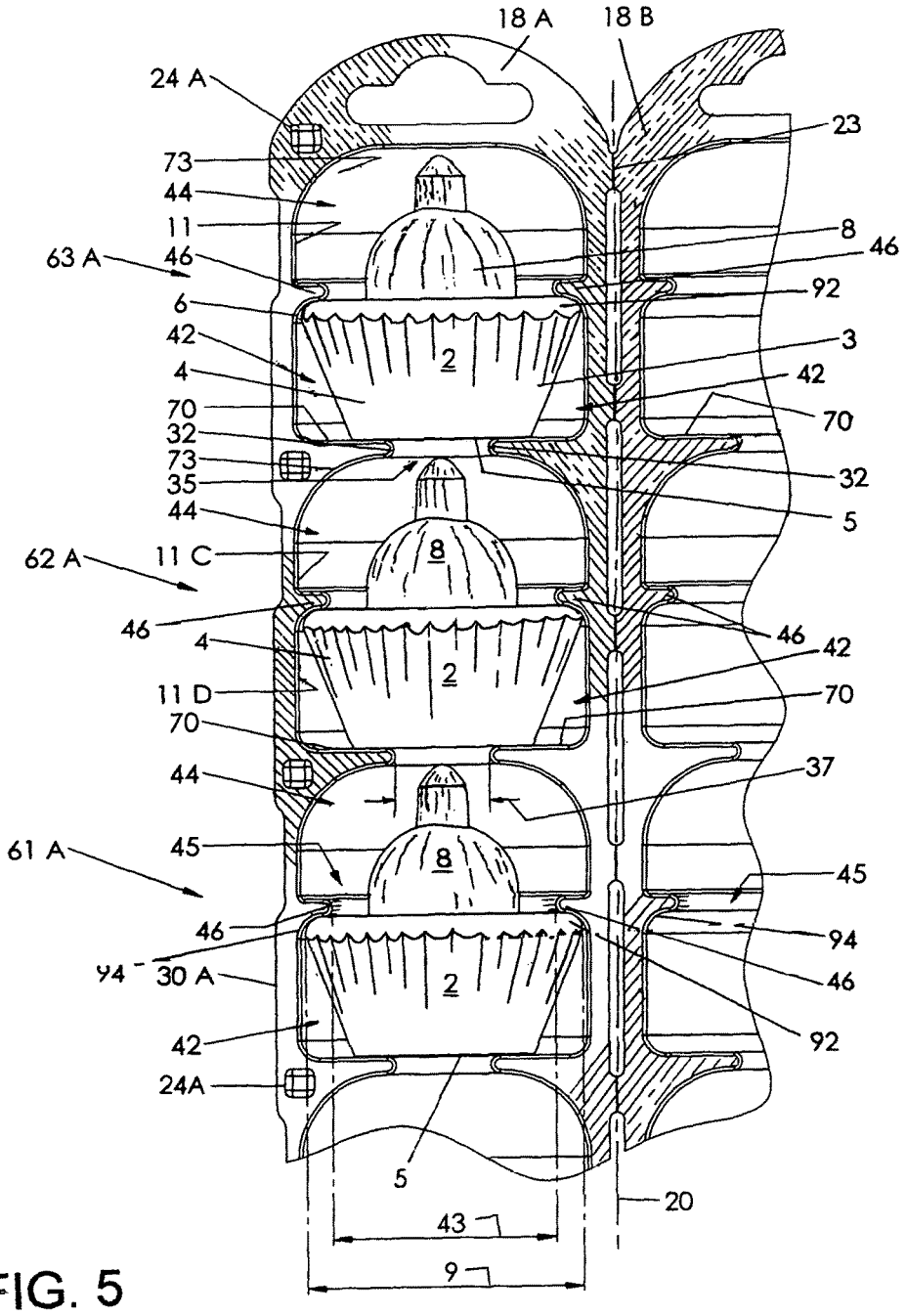
FIG. 5 is a frontal view of a part of a clamshell portion of a multi-compartment cupped comestible package of FIG. 2 of the invention in an open position, wherein exemplary comestible units e.g. cupcakes are shown vertically stacked within compartment halves in a clamshell half.
Figure 5A:
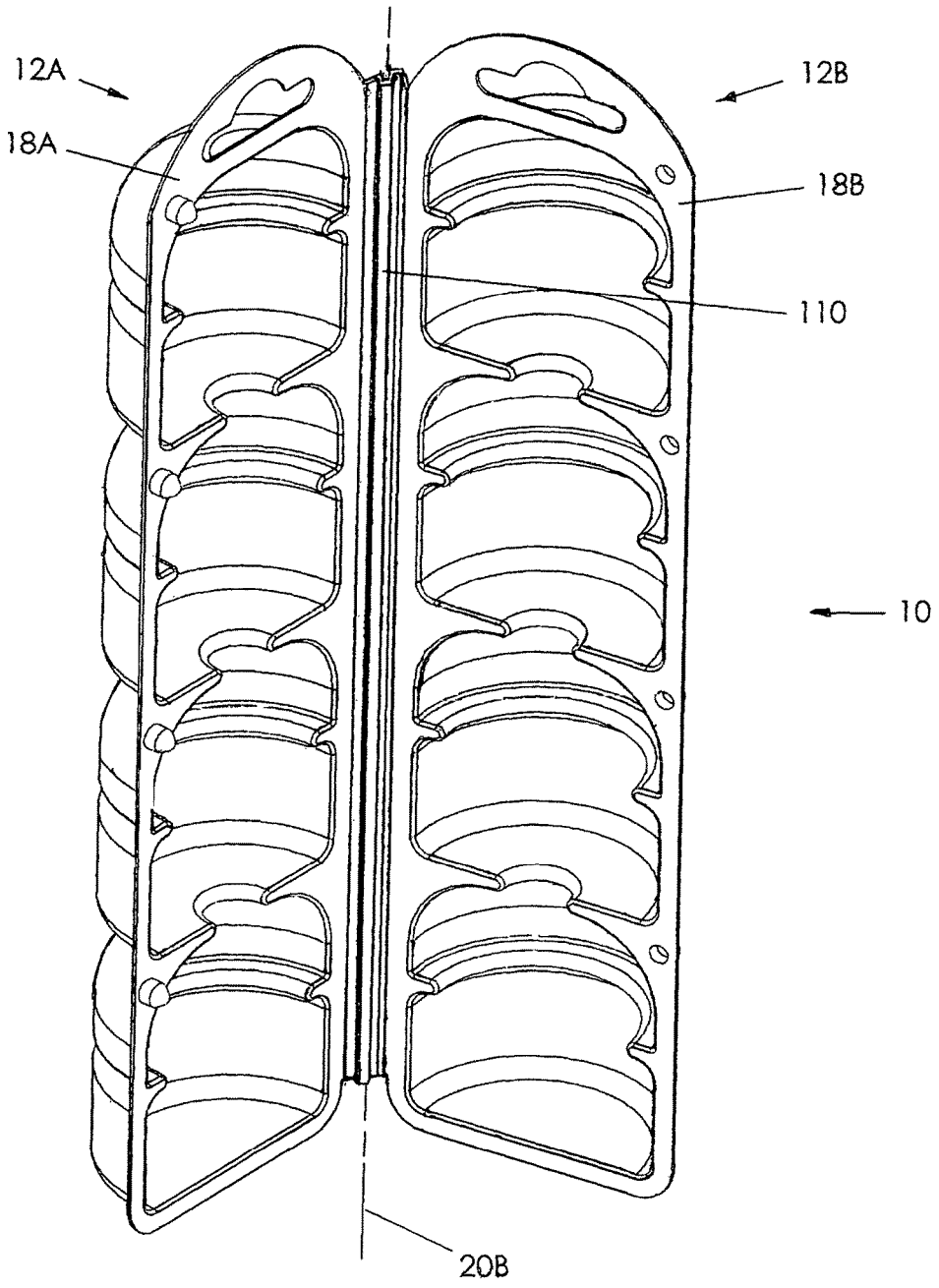
FIG. 5A is an upper perspective view of an open clamshell portion of a comestible package of the invention having an alternative hinge construction.
Figure 5B:
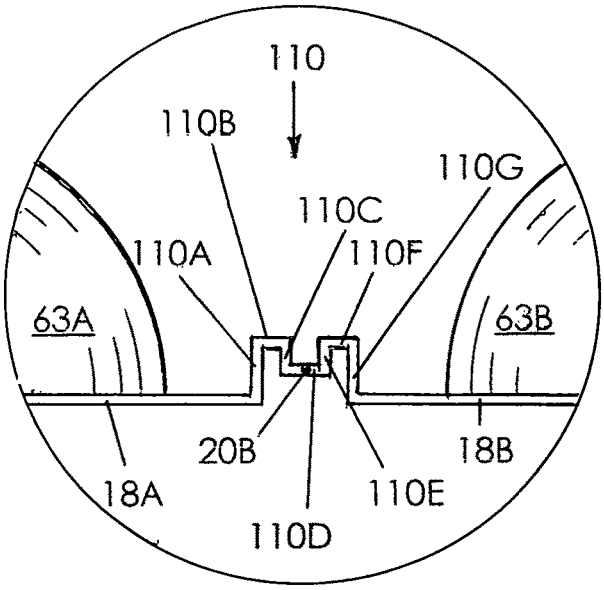
FIG. 5B is an enlarged top view of a hinged portion of the comestible package of FIG. 5A in an open position.
Figure 5C:
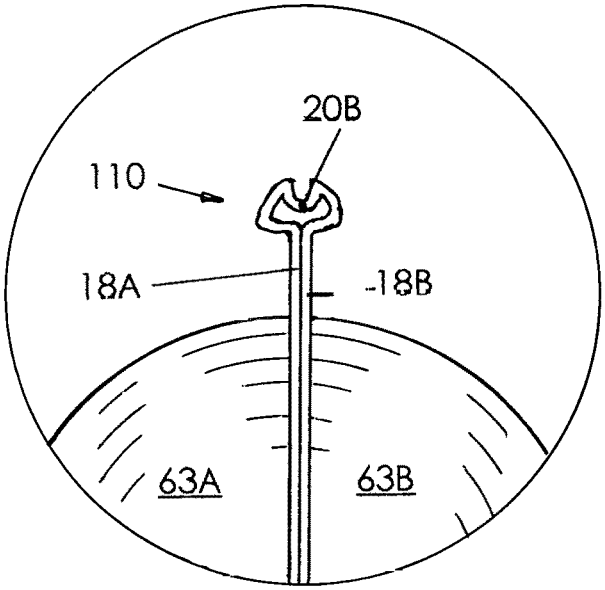
FIG. 5C is an enlarged top view of a hinged portion of the comestible package of FIG. 5A in a fully closed position.
Figure 6:
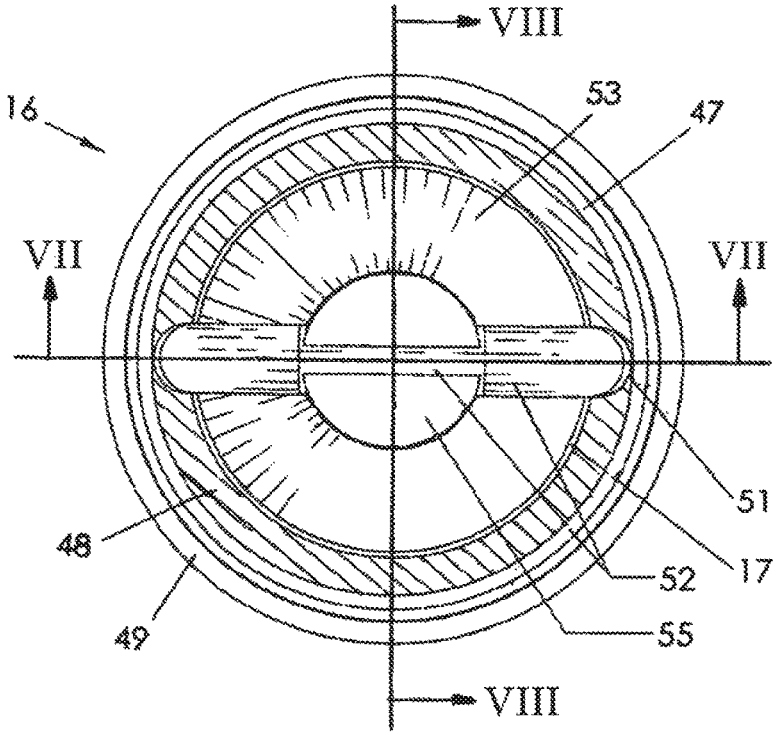
FIG. 6 is a top view of a base member of a cupped comestible package in accordance with the package of FIG. 2.

Alternatively, a box hinge may be used, as illustrated in FIGS. 5A, 5B and 5C. As shown, a box hinge 110 is formed with a plurality of longitudinal members 110A, 110B, 110C, 110D, 110E, 110F, and 110G. The longitudinal members are formed in an articulated arrangement to enable a portion of the total bending to occur within each member and at the joints 111 between members. Thus, the degree of bending in each member is greatly limited, and the package 10 may be opened or closed with less force. In addition, the box hinge forces the two flanges 18A and 18B together upon closure. Typically, the box hinge 110 is used as a full length living hinge to seal the package along the hinge line 20.

FIG. 5B is a top view of the box hinge 110 as formed by molding, i.e. in an open position. FIG. 5C shows the box hinge when closed, each of the longitudinal members absorbing a portion of the bending forces, and bending to a much limited extent when compared to full bending along a single axis.

The foregoing types of hinge construction result in a self-aligning closure of clamshell 12, wherein a comestible unit 2 inserted in one of the clamshell package halves 12A, 12B is aligned with the other clamshell half during package closure. The self-aligning feature is especially important in a multi-compartment package for vertically stacking a plurality of comestible units 2.

Figure 2:
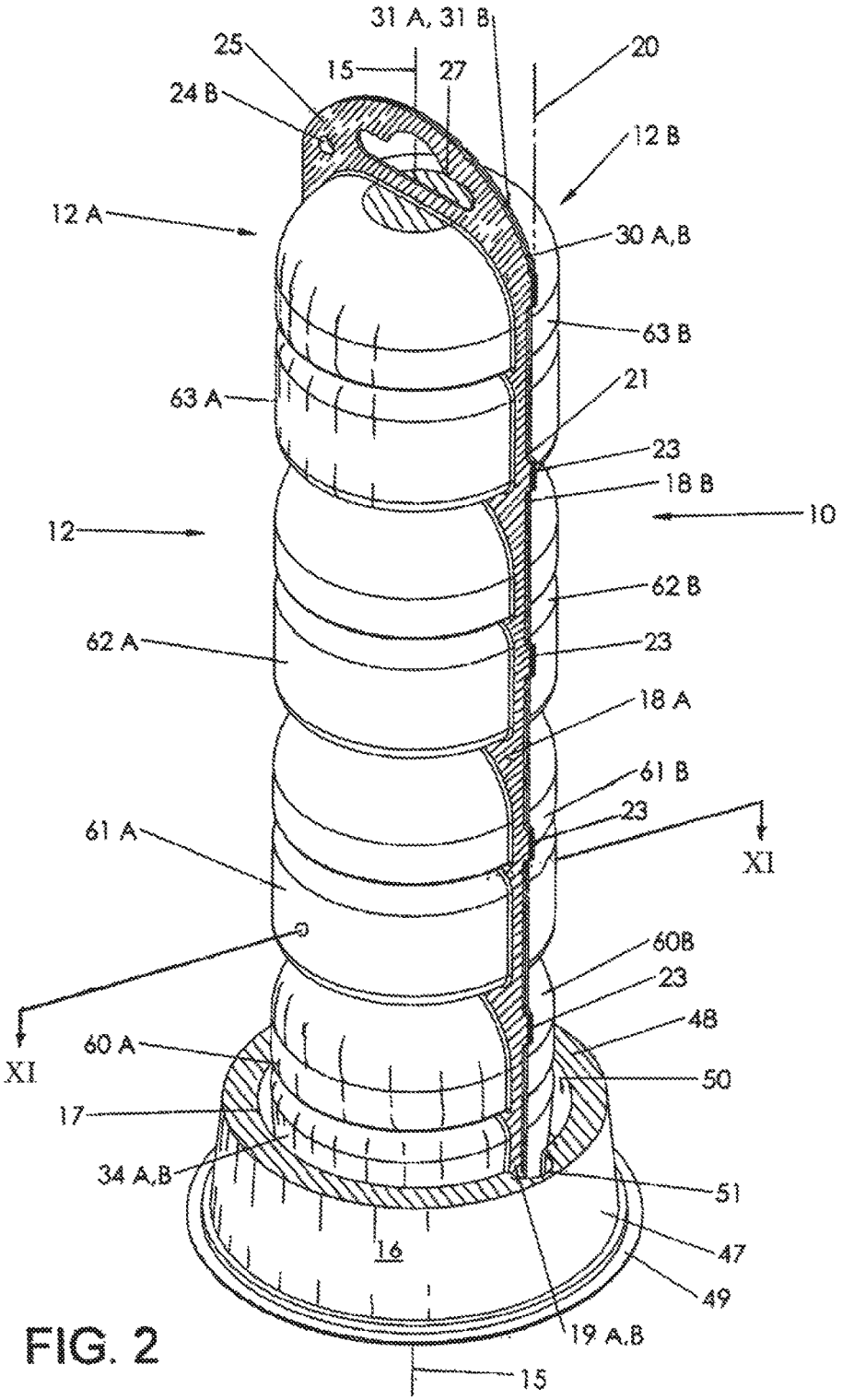
FIG. 2 is a frontal perspective view of an exemplary first embodiment of a closed multi-compartment cupped comestible package of the invention having a clamshell portion mounted in a base member.
Figure 3:
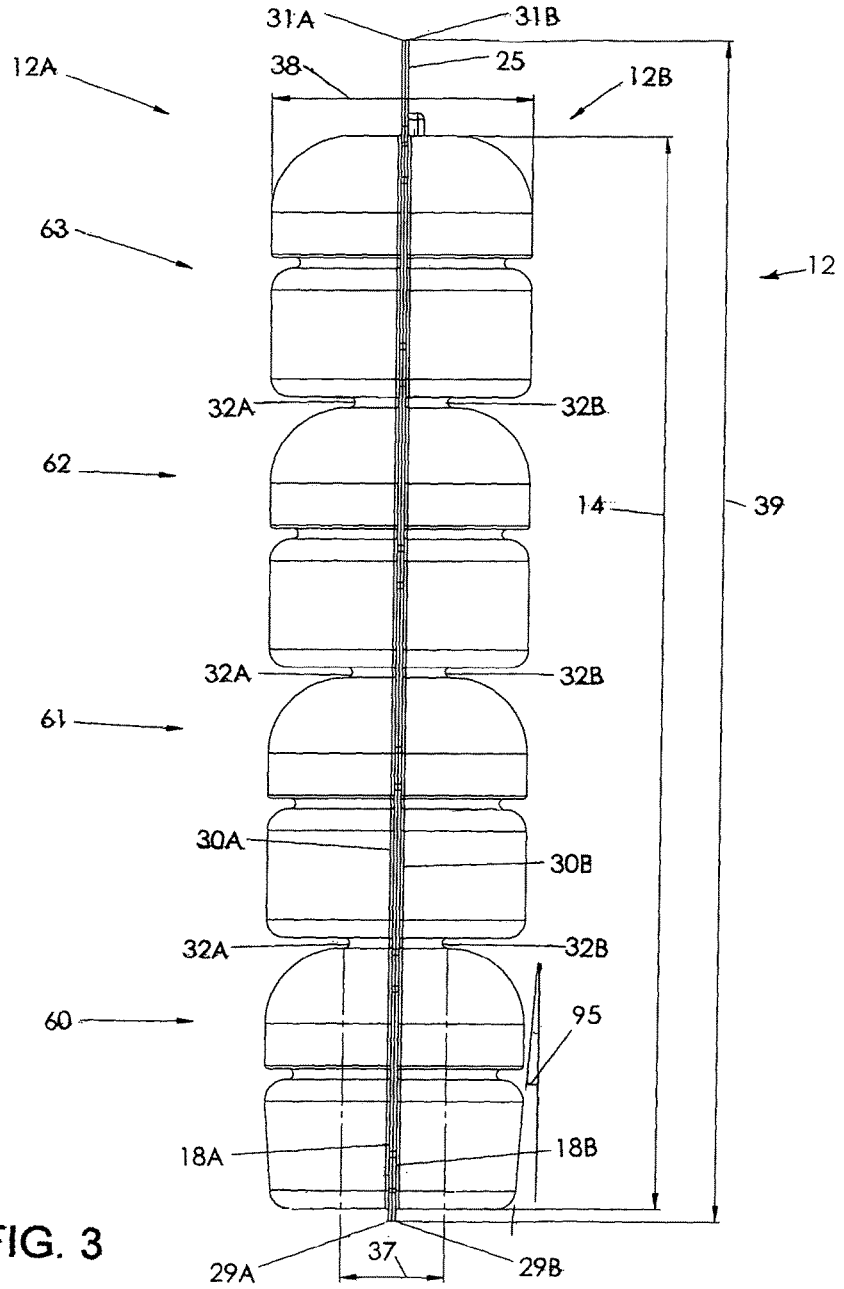
FIG. 3 is a right side view of the closed clamshell portion of a cupped comestible package in accordance with the package of FIG. 2.
Figure 4:
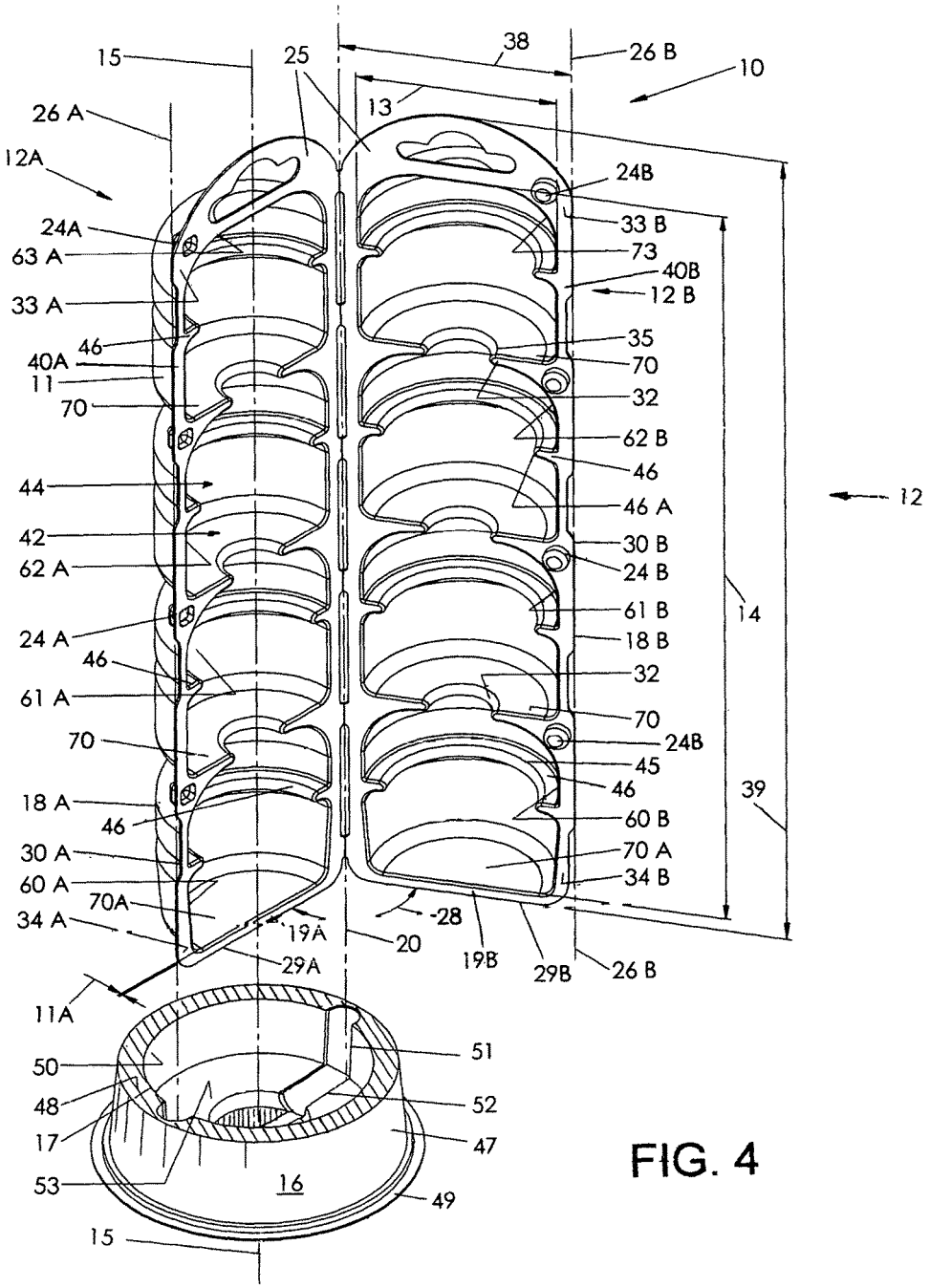
FIG. 4 is a frontal perspective view of a cupped comestible package of FIG. 2 in an open position in accordance with an embodiment of the invention.

Turning now to FIG. 4, in which a clamshell 12 of FIGS. 2 and 3 is shown in an open position. The two clamshell halves 12A, 12B are folded outwardly about hinge line 20 in directions 28, showing the interior of a clamshell 12 having a total of four compartments.

The configuration of all compartments 60, 61, 62, and 64 is substantially the same, with several exceptions. Each compartment is shown as comprising a lower section 42, an upper section 44, and an intermediate circular retainer ring 46.

The lower section 42 of each of the three uppermost compartments 61, 62 and 63 comprises (a) a floor 70 for supporting a cupped comestible 2 by its cup bottom 5, and (b) sidewalls 11 extending upwardly from floor 70 to retainer ring 46. Each floor 70 is shown as having a generally central aperture 35 in a short neck 32 connecting the floor 70 of the lower section 42 to the ceiling 73 of the upper section 44 of the next lower compartment. While the resistance to flexing or bending resulting from each neck 32 generally increases with neck diameter 37, the neck must be small enough to ensure sufficient floor area for effective comestible support. As shown, no aperture is formed in the floor 70A of the lowermost compartment 60. Each neck 32 connecting adjacent compartments provides resistance to bending or flexing of the clamshell portion 12, enabling use of a very thin wall thickness 11.

The upper section 44 of the three lowermost compartments 60, 61, and 62 comprises sufficient space for containing the topping portion 8 of the comestible e.g. cupcake 2, avoiding contact of topping with the upper section walls. The upper section 44 comprises sidewalls 11 extending outwardly and upwardly from the retainer ring 46, and is shown with a dome-like or radius ceiling 73.

Figure 11:
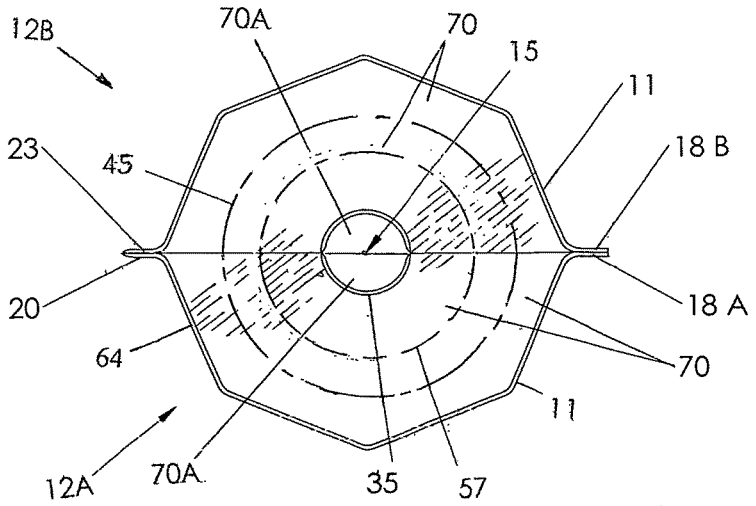
FIG. 11 is a top cross-sectional view of another embodiment of a cupped comestible package of the invention as taken along line XI-XI of FIG. 2 but with a differing cross-sectional compartment shape.

As depicted in FIGS. 2-5, each compartment 60, 61, 62, and 63 is shown with a generally circular shape in a top view. Other shapes may be used which are also readily formed by molding, including walls 11 with multiple faces, e.g. hexagonal, octagonal, or otherwise multi-faceted. FIG. 11 depicts an exemplary compartment having an octagonal shape.

Turning now to FIG. 5, each clamshell half 12A, 12B is shown as including one-half of an annular retainer ring 46 within each half-compartment 60A, 60B 61A, 61B, etc. The retainer ring 46 has a central aperture 45 of diameter 43 such that the retainer ring overlies the upper edge 6 of a comestible cup 3. The upper edge 6 of the cup 3 is shown with a diameter 9. When the comestible is a cupcake or muffin, the retainer ring 46 may be configured to overlie the upper cup edge 6 or a circumferential overflow lip 92 of the comestible. For example, such comestibles may be formed, e.g. baked, to (a) partially fill the cup 3; (b) completely fill the cup; or (c) overflow the cup, forming a lip 92 of baked comestible over the cup's corrugated upper edge 6. Depending on the form (a), (b), or (c) which the comestible takes, the retainer ring is positioned for close alignment with the comestible unit 2 to prevent upward and lateral movement thereof. As illustrated in FIG. 5, the retainer ring 46 may have an arcuate lower surface 94 to conform to an overflow lip 92 of a comestible e.g. cupcake. The upper section 44 is shown with sidewall 11C through which a comestible topping 8 may be viewed, and the lower section 42 has a sidewall 11D.

It is noted that placement of a comestible unit 2 in a compartment of the instant package ensures that the only portion of the cup 3 which is in contact with the package is the cup bottom 5 although if the cup 3 is not overfilled, the retainer ring 46 is configured to contact the upper edge 6 of the cup. Inasmuch as at least one half of the cup's lateral side 4 is exposed upon opening the package 10 clean removal of a comestible unit 2 from the package is easy. Insertion and removal of a comestible may be accomplished with little effort and without hand contact with the top or topping of the comestible.

While the lower section 42 of each compartment is shown as generally having a tubular shape, it may alternatively have a frusto-conical shape which proximates the exterior side 4 of a comestible cup 3. Preferably, the walls 11D of the lower section 42 may be configured to provide space about the cup side (as shown in the figures), further assisting in placement of a person's fingers (not shown) about the cup side 4 for easy cup insertion and removal. In any case, the shape of the lower section 42 of the lowermost compartment 60 and the shape of the base member cavity are conformable.

While the cross-sectional shape of the package compartments 60, 61, 62, and 63 are shown in the figures as being generally circular about the centerline 15 the compartments may be formed to any shape which will retain the particular comestible(s) substantially immoveable within the package 10. Thus, for example, cups 3 may be made for forming a cupped comestible unit 2 in shapes other than circular. Such general shapes may include square, oblong, triangular and the like.

The clamshell 12 including flanges 18A and 18B is formed as a continuous thin wall 11 of plastic or other readily-shaped material. The wall thickness 11A may vary, depending upon the material of construction and its bending properties, dimensions of the package 10 weight of the enclosed comestibles 2 and other factors. For example, a four-compartment comestible, e.g. cupcake package 10 formed of commercially available food-grade polyethylene will require a minimum wall thickness 11A of at least about 0.015 inch (0.38 mm) to provide necessary strength. A preferred wall thickness 11A is about 0.020-0.025 inches (0.508-0.635 mm), but, for example, may be slightly greater for a package 10 for containing large comestibles 2, or for containing more than about four comestible units, e.g. cupcakes. Likewise, a material with greater strength than polyethylene may be useable at a lesser wall thickness.

The preferred method of construction of package 10 is thermoforming, such as plug assist molding, as known in the art. Materials of construction useful with this invention include food grade thermoplastics such as PET, RPET, and PETG, all of which provide excellent clarity and transparency. Such materials are typically recycleable. Materials which may be used include biodegradable plastics and translucent materials. Optionally, colorants may be included in the raw materials from which portions or all of the clamshell portion 12 and/or its base member 16 are formed. Optionally, designs or labelling may be formed in or on the walls 11 or attached thereto, as known in the art.

Construction methods other than thermoforming may also be used. Such methods include, for example, injection molding, extrusion molding, blow molding and rotational molding.

Where a comestible package is intended for single use, and must be sealed against moisture, dust and other fine contaminants, an adhesive sealant may be applied in a narrow band on the inner surface 33A and/or 33B of flanges 18A and/or 18B. Alternatively, a pre-formed frame, not shown, of tape-covered adhesive may be applied to the surface of one flange, whereby removal of the tape exposes the adhesive. Closure of the flanges seals the package.

Spaced connectors 24 exemplified as male and female detents or snaps 24A and 24B may be integrally formed proximate the opening edges 30A, 30B in opposing flanges 18A and 18B to lock the flanges (and thereby the clamshell halves 12A and 12B) to each other, closing and substantially sealing the package clamshell 12. A plethora of connector types applicable to packaging are known in the art. In this invention, the preferred connectors 24A, 24B are integrally formed with the clamshell halves 12A, 12B and have an interference fit with round/square snap options. The connectors 24A, 24B lock package 10 sufficiently to prevent inadvertent opening, yet enable ready separation of flanges 18A, 18B by finger pressure of a user to open the clamshell halves 12A, 12B. Preferably, connectors 24 are spaced between vertically adjacent compartments 60A, 60B, 61A, 61B, etc. to maintain the inner surfaces 33A and 33B of flanges 18A, 18B in mutual contact.

As shown in FIG. 4, the flanges 18A, 18B may be formed with outwardly-extending pull-apart tabs 40A, 40B on opening edges 30A, 30B and/or upper edges 31A, 31B of the respective flanges 18A and 18B. Preferably, pull-apart tabs 40A and 40B are offset from each other for pulling the flanges apart with one's fingers. Preferably, tabs 40A and 40B are offset in the vertical direction, and are best positioned to be near connectors 24A, 24B at the upper end of the package 10 whereby finger manipulation of the tabs readily opens the connectors to separate the flanges and thus open package 10.

When the clamshell halves 12A, 12B are folded together to be closed and locked, as depicted in FIGS. 2 and 3, the lower portions 34A, 34B of clamshell 12 including lower flange portions 19A, 19B are insertable by slight pressure into cavity 17 of separate base member 16. Thus, the complete two-part package 10 is enabled to stand erect on a flat surface.

Looking at FIGS. 2, 4, and 6-8, base member 16 is shown as comprising a bowl-like container having outer wall 47, upper surface 48, foot flange 49, and a central cavity 17 extending downwardly from upper surface 48 with cavity walls 50. The cavity 17 includes at least two laterally opposed cavity extensions 51 generally extending from the upper surface 48 of the base member 16 to floor 53. A downward cavity extension 52 in floor 53 connects the laterally opposed cavity extensions 51. The inner wall 50 of central cavity 17 is slightly angled inwardly from top to bottom (frusto-conical) at angle 96 (see FIG. 7).

Also, as shown in FIG. 3, the lowermost compartment 60 of a clamshell 12 has a lower section 42 with a frusto-conical external shape having the same or slightly less angle 95 with the vertical, i.e. centerline 15. Preferably, angles 95 and 96 are in the range of about 3 degrees to about 5 degrees. The placement of the lowermost section 42 of closed clamshell 12 into cavity 17 with slight hand pressure locks the clamshell 12 within base member 16, yet enables separation by hand. The diameter 54 of foot flange 49 is sufficiently greater than the clamshell width 13 (see FIG. 3) to enable the package 10 to stand upright on a flat surface (not shown). The instant embodiment of base member 16 also shows a central depression 55 in floor 53 to further assist in support of the entire package 10. Use of the base member 16 further locks package 10 by pressure-fit in its closed position, preventing inadvertent opening.

The base member 16 provides surfaces for attachment thereto of desired and required labels. Manufacturer identification, part number, recycle information, and/or other information may be molded into the depressed floor 55 for viewing from below. In addition, labeling to conform to FDA food standards may be conveniently attached to the exterior surface of depressed floor 55 and/or to the outer wall 47 by adhesive, e.g. glue dot.

An important feature of the base member 16 is that, like the clamshell 12 already described, it is formable in one piece by thermal molding of a thermoplastic material. It may be formed to have a thin wall thickness 11A, typically about 0.020-0.025 inch. Thus, the quantity of plastic material used is substantially minimized, reducing production costs yet providing sufficient strength to maintain package integrity. The package 10 is fully recycleable or may be formed of biodegradable material. The walls 11 of the clamshell halves 12A, 12B and the base member 16 are tapered to enable ready release and removal from a mold (not shown). Thus, a further advantage of both the clamshells 12 acid base members 16 is that large numbers of each may be nested to reduce storage space and shipping costs.

Figure 8A:
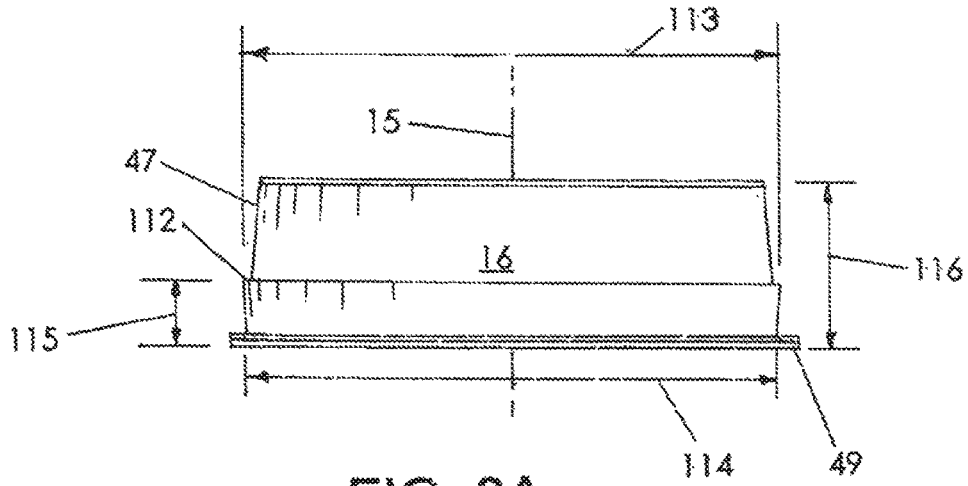
FIG. 8A is a side view of a base member of another embodiment of a cupped comestible package of the invention.
Figure 7:
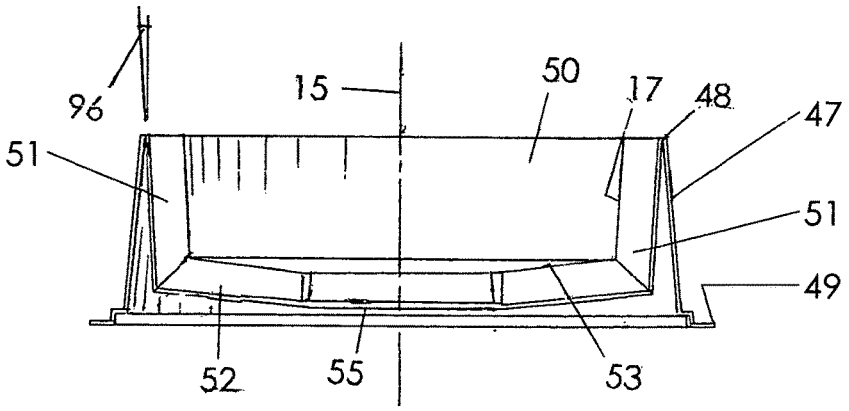
FIG. 7 is a cross-sectional frontal view of a base member of a cupped comestible package of FIG. 2, as taken along line VII-VII of FIG. 6.
Figure 8:
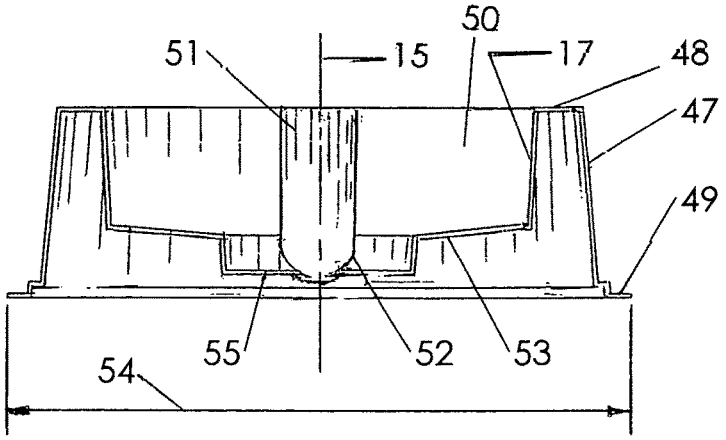
FIG. 8 is a cross-sectional side view of a base member of a cupped comestible package of FIG. 2, as taken along line VIII-VIII of FIG. 6.

Nesting of the base members 16 may be enhanced by modifying wall 47 to provide a stacking step 112 around the perimeter of the base member, as shown in FIG. 8A. The stacking step 112 prevents adjacent base members from tightly clinging to each other when stacked, enabling ease of separation thereof. Thus, step 112 is positioned to provide a slight space between adjacent base members.

As shown in FIG. 8A, the outside diameter 113 of step 112 about centerline 15 is formed to be slightly greater than the inside diameter 114 of flange 49, so that the flange of the next higher base member 16 will rest on step 112 of the base member below it. The height 115 of the step 112 as a fraction of the overall base height 116 is a function of angle 96 (see FIG. 7).

As shown in FIGS. 2-5, the upper ends 31A, 31B of flanges 18A, 18B respectively may be extended to comprise a hanging tab 25 with aperture 27 therethrough, enabling hanging of the package 10 on a standard retail store support rod (not shown).

Furthermore, package 10 is configured for attachment of a label (not shown) providing information relating to manufacturer, product description, etc. When used for packaging food products, FDA labeling applies, consisting of adhesive labels (not shown) which may be attached to adjacent flanges 18A, 18B to cover the closing edges 30A, 30B for so-called "tamper-indication" construction.

As shown in FIGS. 2-5, the floor 70 of each compartment 61, 62, and 63 of clamshell 12 is connected to ceiling 73 of the next lower compartment by a short hollow neck 32, which limits relative movement between the compartments. Thus, as shown in FIG. 5, neck 32 with central inter-compartmental aperture 35 connects floor 70 of compartment 63 to the ceiling 73 of compartment 62, the latter positioned below compartment 63. Aperture 35 of neck 32 is of a diameter 37 (sec FIG. 3) which is small enough to permit support of a comestible unit 2 placed therein, yet large enough to provide the desired rigidity between adjacent compartments. The lowermost compartment 60 is shown with a floor 70A which is continuous within each compartment half 60A, 60B having no neck 32 attached thereto. Likewise, the uppermost compartment 63 does not require a neck 32.

Figure 9:
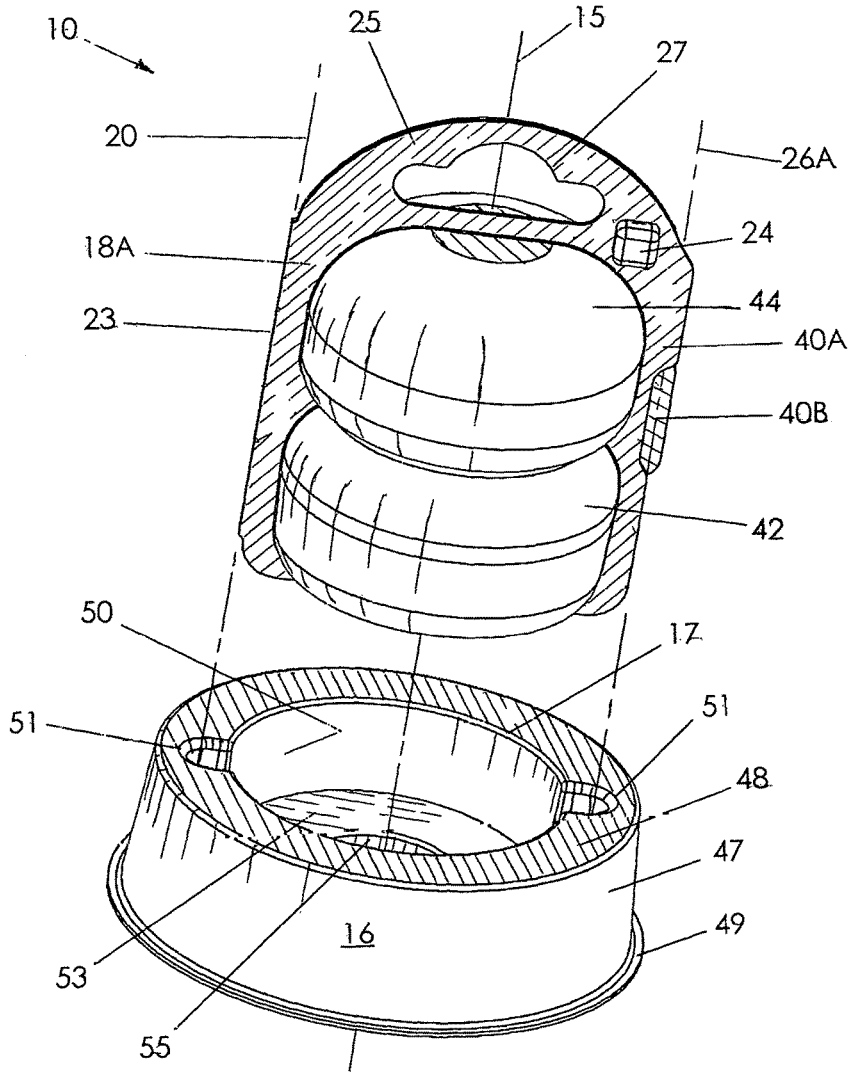
FIG. 9 is a frontal perspective view of a single-unit cupped comestible package of the invention, illustrating a closed clamshell portion and an exemplary base member into which the clamshell portion may be mounted.
Figure 10:
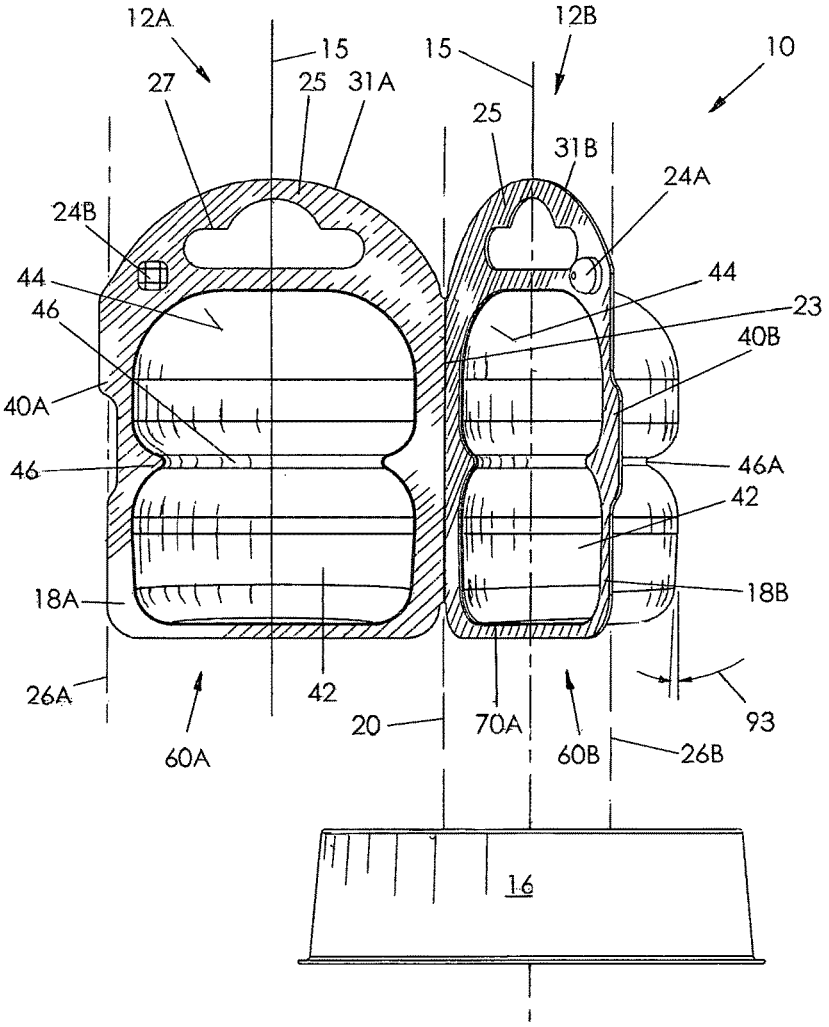
FIG. 10 is a frontal view of a single-unit cupped comestible package of FIG. 9 in an open position, showing the interior of a clamshell portion thereof.

FIGS. 9 and 10 depict a single-compartment package 10 of the invention for holding a single comestible unit 2. This package has the same general construction as the four-compartment clamshell 12 and base member 16 already described in FIGS. 2 through 8. Part numbers in FIGS. 9 and 10 are as previously described in relation to the descriptions of FIGS. 2-5, but this embodiment has no inter-compartmental features.

As shown in FIGS. 9 and 10, clamshell 12 has two clamshell halves 12A and 12B, which are connected by hinge member 23 along hinge line 20. Circumferential flanges 18A and 18B of halves 12A and 12B, respectively, may be joined face-to-face as shown in FIG. 9, to close the package. A connector 24 is shown, comprising a male portion 24A and a female portion 24B in the respective flanges. The mating flanges 18A, 18B are formed with a hanging tab 25 and offset pull-apart tabs 40A and 40B for opening the clamshell 12. The lower section 42 of the compartment may be configured to be mounted in the cavity walls 50 of base member 16, i.e. by having a frusto-conical angle 93 with the vertical. Base member 16 is configured as previously discussed.

FIG. 11 shows a cross-sectional vertical view Xl-XI through a closed clamshell compartment of FIG. 2. In this case, the side wall 11 of each clamshell half 12A and 12B forms half of an octagonal compartment 64 on each side of the joined flanges 18A and 18B. An outline 57 of a typical cupcake footprint is shown on compartment floor 70 with the lowermost floor 70A seen through inter-compartmental neck aperture 35. The room between the comestible footprint 57 and distant wall 11 provide additional space for a person's fingers in removing a comestible unit 2. Aperture 45 in retainer ring 46 of the next lower compartment is shown in ghost line.

Figure 12:
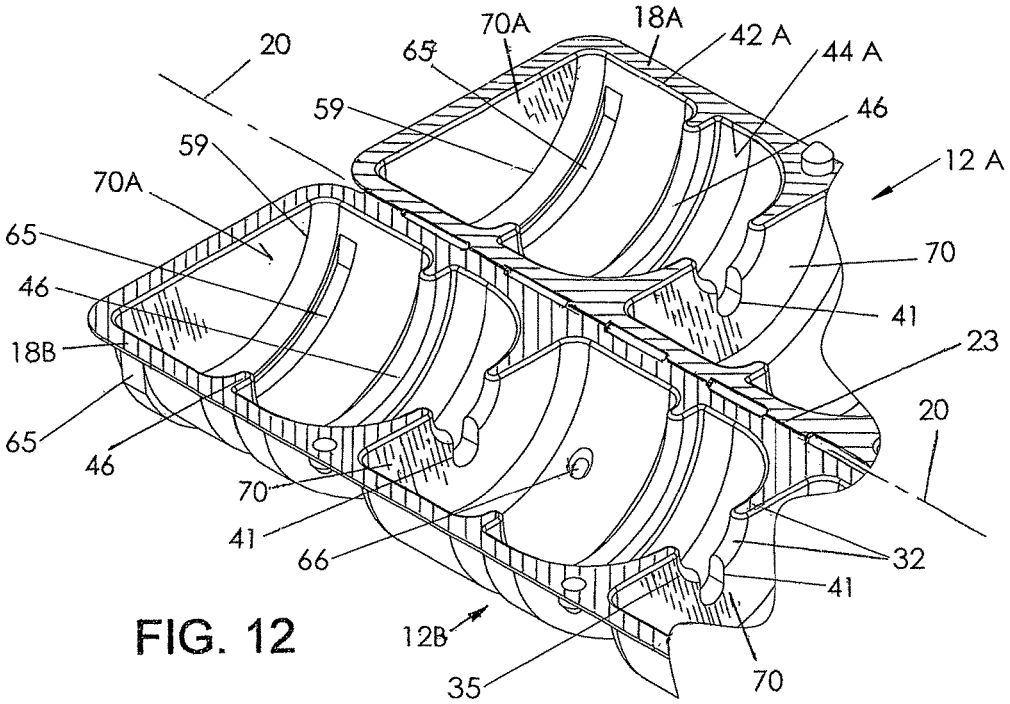
FIG. 12 is an upper perspective view of part of an open clamshell portion of the invention, showing additional features which may be incorporated therein.

We turn now to FIG. 12, which shows a lower portion of a multi-compartment clamshell having clamshell halves 12A, 12B. Several features which may be incorporated in the invention to increase strength are shown. While flanges 18A, 18B make a package more rigid in a direction coplanar with the flanges, the rigidity in an anti-planar direction will be increased to a lesser extent. To strengthen the clamshell 12, hollow neck 32 is extended in an anti-planar direction with neck extensions 41 as exemplified in FIG. 12.

Further rigidity may be achieved by forming one or more outwardly projecting ribs 65 on the clamshell 12, by extending the wall 11 outwardly over a generally narrow portion of the clamshell's circumference 59 on each clamshell half 12A, 12B. An example of this feature is shown in FIG. 12. When the clamshell 12 is to be hung on a hanger, the stiffening members 65 may be formed on the wall 11 of a compartment's lower space 42, to avoid possible visual interference with a view of product topping 8 in the upper space 44. However, when the clamshell 12 is to be mounted in base 16 stiffening members 65 are not formed in the lower sections 42A, 42B of the lowermost half-compartments 60A, 60B, unless the cavity 17 of base 16 is modified to be conformable thereto.

Figure 13:
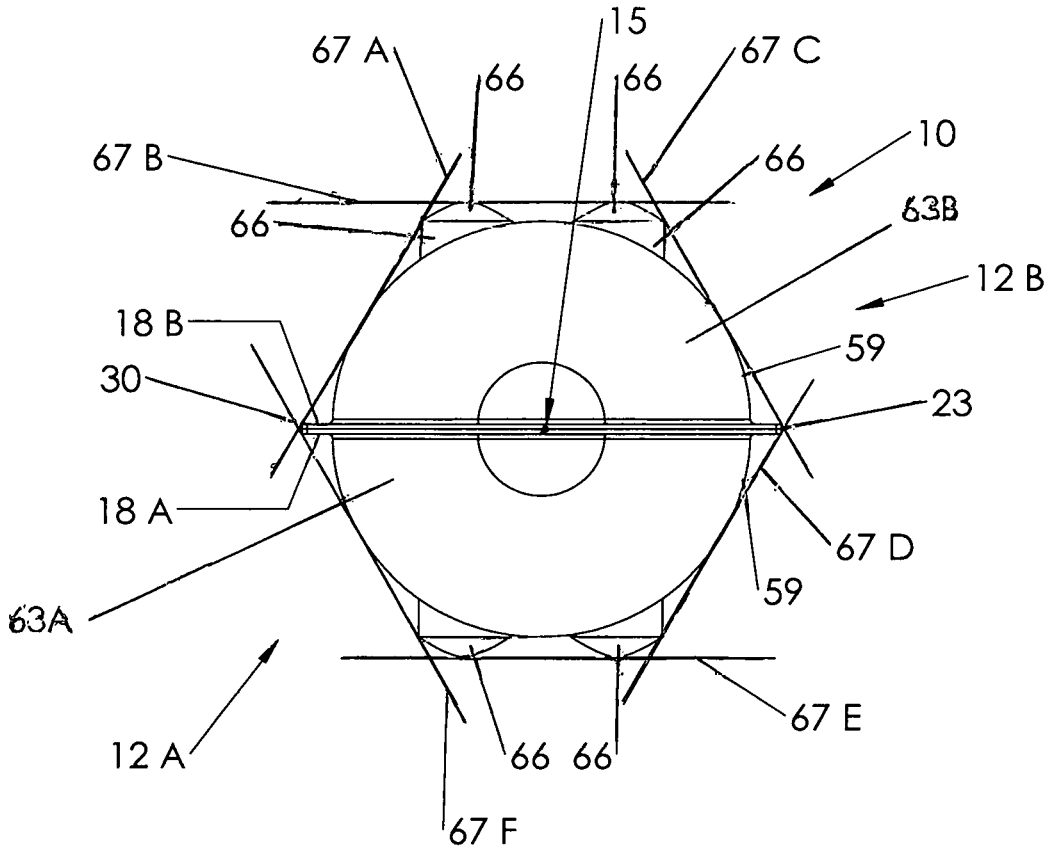
FIG. 13 is a top cross-sectional view of the clamshell portion of FIG. 12 in a closed position, showing a modification thereof to prevent rolling when placed horizontally.

As shown in FIGS. 12 and 13, compartment wall 11 may be extended outwardly over small areas to produce bumps 66 therein. Bumps 66 are shown as spaced about the circumference 59 and effectively prevent a package 10 from rolling if laid horizontally on a flat surface e.g. counter, table, etc. As depicted in the cross-sectional view of FIG. 13, bumps 66 may be advantageously placed in pairs on each clamshell half 12A, 12B to effectively create a 6-sided package with each side arrayed about centerline 15 to be supportable along one of planes 67A, 67B, 67C, 67D, 67E, and 67F, each of which defines an effective support plane. Each support line utilizes bumps 66 together with one of (a) the closing edge 30 and (b) the edge of hinge members 23 of the particular flange half 18A, 18B. The package 10 may be supported on any one of the effective planes identified above, and prevented from rolling thereby.

Figure 14:
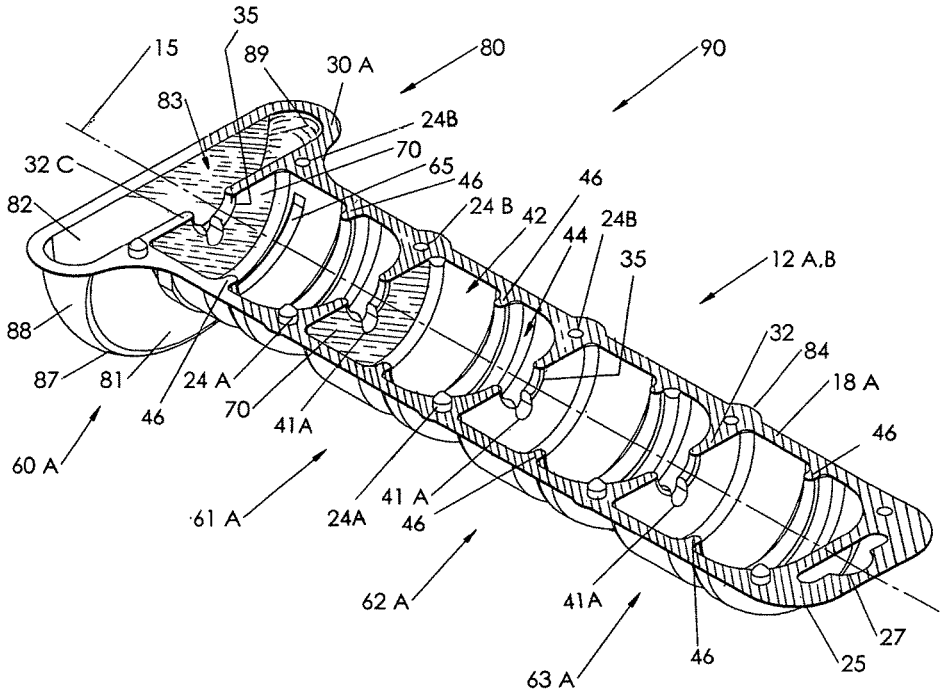
FIG. 14 is an upper perspective view of one clamshell half of another embodiment of a cupped comestible package of the invention, wherein each of two separate clamshell halves includes an integral half of a base member, and showing additional features which may be incorporated therein.

FIG. 14 depicts another version of the comestible package of the invention. One half of package 90 is shown with a plurality of compartment halves 60A, 61A, 62A, and 63A, each as already described above. The differences between the package 10 of FIGS. 2-5 and the package 90 of FIG. 14 are as follows: First, the package 90 is formed from two identical or nearly identical package clamshell halves 12A, 12B each of which is substantially circumscribed by flange 30A. The clamshell halves 12A, 12B are joinable by connectors 24A, 24B to form the complete package 90. Thus, each of the two separate halves 12A, 12B has the same mold design, with mating connectors 24A and 24B along opposed side edges of the flange 30A. If desired, the flange 30A may be extended outwardly to accommodate each connector 24A, 24B. The flange extension 84 is shown in FIG. 14.

Secondly, the package 90 has an integral base 80. Integral base 80 includes an upper member 81 which is closely spaced from floor 70 and which extends radially outward to a greater diameter than the compartments. The base 80 has a lower floor 82 which is perpendicular to center line 15. The lower floor 82 is circular (semi-circular in each clamshell half 12A, 12B). The upper member 81 is joined to the floor 70 by a neck 32C, creating a neck aperture 35 therebetween. A side wall 88 joins the outer periphery 87 of the upper member 81 and periphery 89 of the lower floor 82. A base cavity 83 is formed is formed within the base 80, and is connected to the lower space 42 of the lowermost compartment 60A by neck 32C with neck aperture 35 therein.

Figures 15, 16, 17:
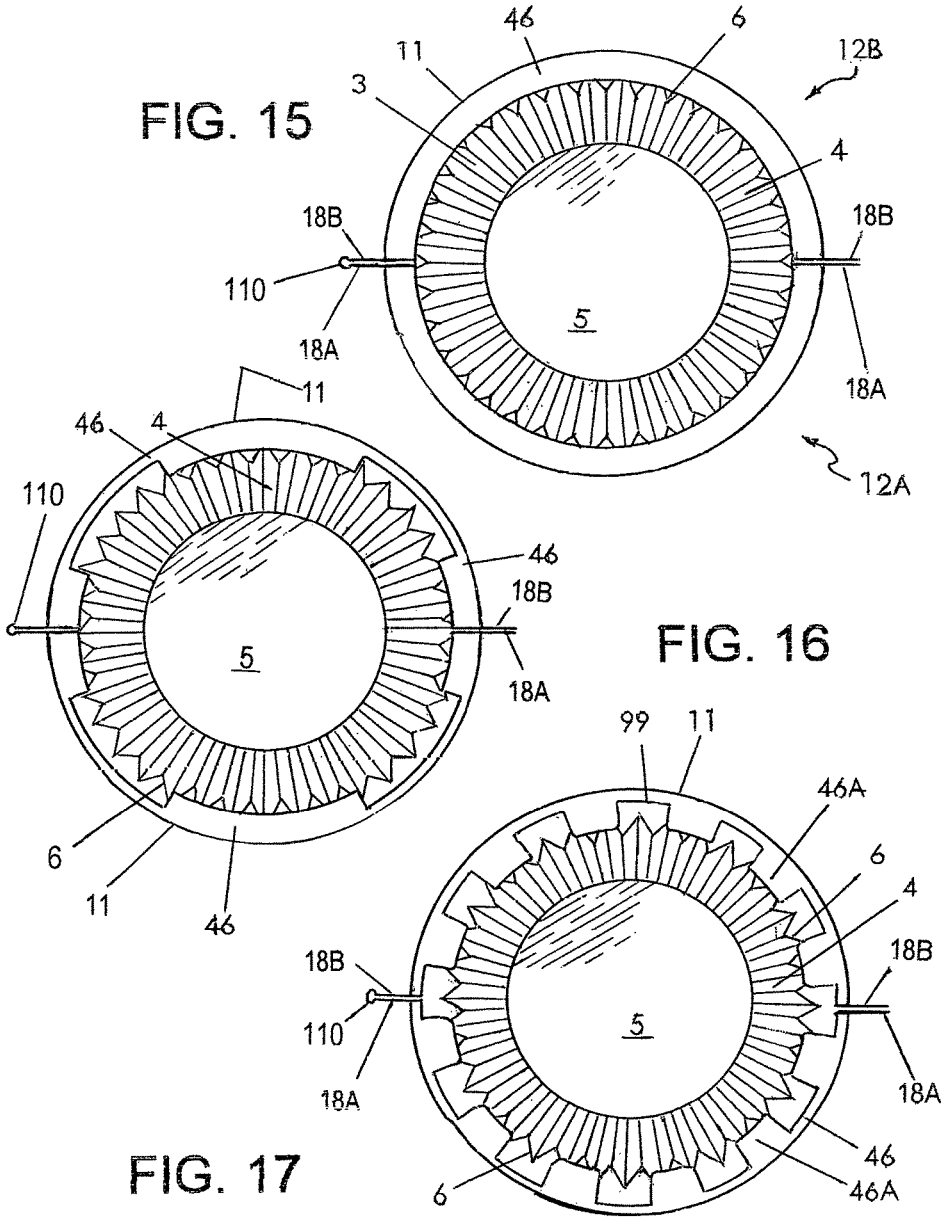
FIG. 15 is an upper cross-sectional view of an exemplary retainer ring of the invention, wherein a pleated cup such as is commonly used for cupcakes is retained in a compartment, and the retainer ring has a generally uniform inner diameter.
FIG. 16 is an upper cross-sectional view of another embodiment of an exemplary retainer ring of the invention, wherein the retainer ring is discontinuous.
FIG. 17 is an upper cross-sectional view of another embodiment of an exemplary retainer ring of the invention wherein the ring includes a series of radially directed projections which retain a pleated cup within a compartment.

As shown in FIG. 15, a cup 3 typically used for cupcakes and muffins has a nearly circular bottom 5 and a circular pleated wall i.e. lateral side 4 having an upper peripheral edge 6. The cup is shown as placed in a compartment 60 of a package 10 of the invention which has wall 11. A retainer ring 46 overlies a portion of the upper peripheral edge 6 of cup 3 and has thus far been described as being split, wherein each half of the ring is a part of one of clamshell half 12A or clamshell half 12B. Thus, the complete ring 46 provides a substantially uniform inner diameter and overlies at least a radial portion of the peripheral edge 6 in its entirety to prevent vertical, lateral and rotational movement of the cupped comestible 2 (not shown in this figure). Also depicted in the figure are the two flanges 18A and 18B which are connected by hinge 110.

FIG. 16 depicts another embodiment of retainer ring 46 in which the ring is discontinuous but covers spaced portions of the cup edge 6.

FIG. 17 shows a further embodiment of retainer ring 46, in which a series of radially-directed projections 46A of ring 46 overlie spaced portions of the upper cup edge 6 to restrain it from movement. The spaced projections 46A are separated by intervening recesses 99. It should be noted that the portion of the upper cup edge which is overlain by the ring or ring projections may vary, depending upon the rigidity of the cup 3 itself Thus, a cupcake in a thin paper cup may require a substantial portion of the cup edge to be overlain, while a comestible unit 2 in a cup formed of semi-rigid plastic or aluminum foil may require less coverage.

Having now described various embodiments of the invention in detail as required by the patent statutes, those skilled in the art will recognize modifications and substitutions to the specific embodiments disclosed herein. Such modifications and substitutions are within the scope and intent of the instant invention.

We claim:

1. A package configured for clean reception, containment, and removal of at least two uptight, cupped comestible units in a vertical stack, wherein said cupped comestible units are formed in first part by an open topped cup defining a bottom wall of a selected transverse size, and a cup sidewall extending upwardly by a selected height from said bottom wall to a peripheral top edge, said peripheral top edge having a selected transverse dimension, and the cupped comestible units are formed in second part by a comestible fill located in said open topped cup, said package comprising:

a walled clamshell structure having two joinable halves variably positionable about a vertical division between open position and closed position, in said closed position forming at least a topmost compartment and a bottommost compartment in vertical alignment, each said compartment configured to, in use, contain a separate cupped comestible unit, and when in said open position each of said halves having an open side at said vertical division for, in use, clean reception or removal of one of the cupped comestible units by lateral passage through a one of said open sides;

wherein said topmost compartment and bottommost compartment each are bounded in height by a compartment floor and a compartment ceiling and carry between them an intermediate level retainer ring, said compartments each being divided into an upper section and a lower section separated by said retainer ring, said lower section having a lower sidewall extending between said compartment floor and the retainer ring;

wherein the compartment floor is suitably sized, in use, to receive the bottom wall of a cupped comestible unit contained in the lower section, said lower sidewall spacing the compartment floor from the retainer ring by said selected height of said cup sidewall, thereby locating the retainer ring at a height, in use, atop said peripheral top edge of said open topped cup when the open topped cup is contained in the lower section, and the retainer ring defines an open central aperture of lateral dimension less than said selected transverse dimension of the peripheral top edge of the open topped cup, whereby, in use, the cupped comestible unit is engaged between the retainer ring and the compartment floor, restraining the cupped comestible unit from vertical, lateral, and rotational movement; and wherein the compartment floor of the topmost compartment defines an inter-compartmental neck extending through said compartment ceiling of the compartment therebelow and forming a neck aperture of smaller transverse dimension than either the top compartment floor or said open central aperture of the retainer ring.

2. A package in accordance with claim 1, further comprising a base member of enlarged diameter to support said package in said closed position on a flat surface, said base member comprising:

a thermoformed container having:

a top surface; and an outer wall with a lower foot flange;

wherein said top surface defines a central cavity having frusto-conical sidewalls;

whereby insertion of said package in the closed position into said central cavity locks the package therein to enable said package to stand upright.

3. A package in accordance with claim 2, wherein said frusto-conical sidewalls have an angle of from about 3 degrees to about 5 degrees with the vertical.

4. A package in accordance with claim 1, wherein said open central aperture of said retainer ring is of uniform diameter for, in use with a contained open topped cup, overlying a radial portion of said peripheral top edge of said cup sidewall.

5. A package in accordance with claim 1, wherein said retainer ring comprises radial projections to, in use with a contained open topped cup, overlie discontinuous circumferential portions of said peripheral top edge of said cup sidewall.

6. A package in accordance with claim 5, wherein at least two said radial projections are positioned, in use with a contained open topped cup, to overlie said peripheral top edge on opposite sides of said open topped cup.

7. A package in accordance with claim 1, wherein said package comprises between two and twelve compartments positioned in vertically stacked configuration.

8. In combination, a cupped comestible unit and a package containing said cupped comestible unit, wherein:

the cupped comestible unit comprises:

in first part, an open topped cup defining a bottom wall of a selected transverse size, and a cup sidewall extending upwardly by a selected height from said bottom wall to a peripheral top edge, said peripheral top edge having a selected transverse dimension; and in second part, a comestible fill located in said open topped cup; and wherein said package comprises:

a compartment containing the cupped comestible unit , wherein said compartment is formed of a walled clamshell structure having two joinable halves variably positionable about a vertical division between an open position and a closed position, and when in said open position the compartment halves define an open side at said vertical division providing passage space for lateral passage of the cupped comestible unit through said open side;

wherein said compartment is bounded in height by a compartment floor at a lower end thereof and a compartment ceiling at an upper end thereof and carries between them an intermediate level retainer ring, the compartments being divided into an upper section and a lower section separated by said retainer ring, said lower section having a lower sidewall of a height measured between the compartment floor and the retainer ring equal to said selected height of said cup sidewall;

whereby when said bottom wall of the cupped comestible unit is supported on the compartment floor, the retainer ring is atop said peripheral top edge; and wherein the retainer ring defines an open central aperture of lateral dimension less than said selected transverse dimension of the peripheral top edge, whereby the cupped comestible unit is engaged between the retainer ring and the compartment floor, restraining the cupped comestible unit from vertical, lateral, and rotational movement.

9. The combination in accordance with claim 8, further comprising a base member of enlarged diameter supporting said package in said closed position on a flat surface, said base member comprising:

a thermoformed container having:

a top surface; and an outer wall with a lower foot flange;

wherein said top surface defines a central cavity having frusto-conical sidewalk;

whereby insertion of said package in the closed position into said central cavity locks the package therein and enables the package to stand upright.

10. The combination in accordance with claim 9, wherein said frusto-conical sidewalls have an angle of from about 3 degrees to about 5 degrees with the vertical.

11. The combination in accordance with claim 8, wherein said open central aperture of said retainer ring is of uniform diameter continuously overlying a radial portion of said peripheral top edge of said cup sidewall.

12. The combination in accordance with claim 8, wherein said retainer ring comprises at least two radial projections overlying discontinuous circumferential portions of said peripheral top edge of said cup sidewall.

13. The combination in accordance with claim 12, wherein at least two of said radial projections overlie said peripheral top edge on opposite sides of said open topped cup.

14. The combination in accordance with claim 8, wherein said package comprises between two and twelve said compartments positioned in a vertical stack.

15. The combination in accordance with claim 8, wherein:

said package comprises at least two said sequentially located compartments positioned in a vertical stack, comprising a relatively upper compartment and a relatively lower compartment, and said compartment floor of said relatively upper compartment defines an inter-compartmental neck extending through said compartment ceiling of said relatively lower compartment and forming an aperture of smaller transverse dimension than the transverse dimension of either the compartment floor of said relatively upper compartment or said open central aperture of said retainer ring of the relatively upper compartment.

16. The combination in accordance with claim 8, wherein said open topped cup is frusto-conical in side profile with wider upper end and narrower lower end, and said lower section sidewall is vertical, establishing an entry space between the lower section sidewall and said cup sidewall, providing lateral space for manipulating said cupped comestible unit through said open side when said compartment is in open position.

* * * * *